US007081592B2

(12) United States Patent
Kaelberer

(10) Patent No.: US 7,081,592 B2
(45) Date of Patent: Jul. 25, 2006

(54) MICROMECHANICAL SWITCH

(75) Inventor: Arnd Kaelberer, Schlierbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/517,978

(22) PCT Filed: Feb. 25, 2003

(86) PCT No.: PCT/DE03/00592

§ 371 (c)(1),
(2), (4) Date: Dec. 15, 2004

(87) PCT Pub. No.: WO2004/019357

PCT Pub. Date: Mar. 4, 2004

(65) Prior Publication Data

US 2005/0173233 A1 Aug. 11, 2005

(30) Foreign Application Priority Data

Aug. 2, 2002 (DE) ..... 102 35 369

(51) Int. Cl.
*H01H 35/02* (2006.01)

(52) U.S. Cl. ..... 200/61.45 R; 200/61.48

(58) Field of Classification Search ..... 200/61.45 R, 200/181, 61.48–61.52; 73/514.16, 514.29, 73/514.32, 514.35, 514.36, 514.37, 514.38, 73/510

See application file for complete search history.

(56) References Cited

U.S. PATENT DOCUMENTS

| | | | | |
|---|---|---|---|---|
| 5,712,609 | A | 1/1998 | Mehregany et al. | |
| 5,828,138 | A | 10/1998 | McIver et al. | |
| 6,296,779 | B1 * | 10/2001 | Clark et al. | 216/66 |
| 6,370,937 | B1 * | 4/2002 | Hsu | 73/1.37 |
| 6,463,802 | B1 * | 10/2002 | Hulsing, II | 73/504.04 |
| 6,515,489 | B1 * | 2/2003 | Min et al. | 324/662 |
| 6,765,160 | B1 * | 7/2004 | Robinson | 200/61.45 R |
| 6,843,126 | B1 * | 1/2005 | Hulsing, II | 73/504.04 |
| 6,843,127 | B1 * | 1/2005 | Chiou | 73/504.12 |
| 6,845,669 | B1 * | 1/2005 | Acar et al. | 73/504.14 |
| 6,845,670 | B1 * | 1/2005 | McNeil et al. | 73/514.32 |
| 6,928,874 | B1 * | 8/2005 | Painter et al. | 73/504.13 |
| 6,936,492 | B1 * | 8/2005 | McNeil et al. | 438/50 |

FOREIGN PATENT DOCUMENTS

EP 0 981 052 2/2000

* cited by examiner

*Primary Examiner*—Michael Friedhofer
*Assistant Examiner*—Lisa Klaus
(74) *Attorney, Agent, or Firm*—Kenyon & Kenyon LLP

(57) ABSTRACT

A micromechanical switch having a mass, a first spring element, and a contact element is provided. The mass contacts the contact element if a specified degree of displacement of the first spring element is exceeded.

13 Claims, 1 Drawing Sheet

MICROMECHANICAL SWITCH

FIELD OF THE INVENTION

The present invention is directed to a micromechanical switch having a movable mass connected to a spring element.

BACKGROUND INFORMATION

Micromechanical switches in which a mass is held elastically by a spring element are known in general. During the action of a force, such as an acceleration force, for example, the mass is moved and thus the spring element is displaced.

SUMMARY OF THE INVENTION

The micromechanical switch according to the present invention has the advantage over the conventional micromechanical switches in that the present micromechanical switch is implemented from simple basic elements of surface micromechanics. The micromechanical switch according to the present invention also has the advantage over known switches in that it achieves miniaturization and brings about suppression of switch bounce. Because of its compact size, considerable cost savings are possible. Another factor that is an advantage is that the micromechanical switch according to the present invention results in savings on evaluation electronics compared with an expanded acceleration sensor system. Furthermore, the micromechanical switch according to the present invention may be operated advantageously without a power supply so that it actually functions only as a switching element.

Particularly advantageous is the fact that the at least one contact element is movable and is connected to a second spring element. This effectively reduces switch bounce because the second spring element brings about a certain contact pressure of the contact element against the mass.

Another advantage is that the first spring element and/or the second spring element include U-spring elements. This makes it possible to manufacture the spring elements easily at low cost.

Another advantage is that the spring constant of the second spring element is significantly lower than the spring constant of the first spring element. Because of this, the movement of the mass is not substantially hindered or changed by the movement of the mass as it simultaneously contacts the contact element.

Another advantage is that a third spring element is provided which has a stabilizing effect on the movement of the mass. This makes it possible to control the movement of the mass, which is advantageous.

Another advantage is that the spring constant of the third spring element is significantly lower than the spring constant of the first spring element. Because of this, it is possible that the movement of the mass is not substantially changed by the third spring element, and the movement of the mass is determined essentially by the second spring element.

Another advantage is that a stop is provided that prevents displacement of the first spring element beyond a specified maximum degree of displacement of the first spring element. This prevents the micromechanical switch from being destroyed in the event of an excessively great acceleration of the mass.

DETAILED DESCRIPTION

Figure 1:
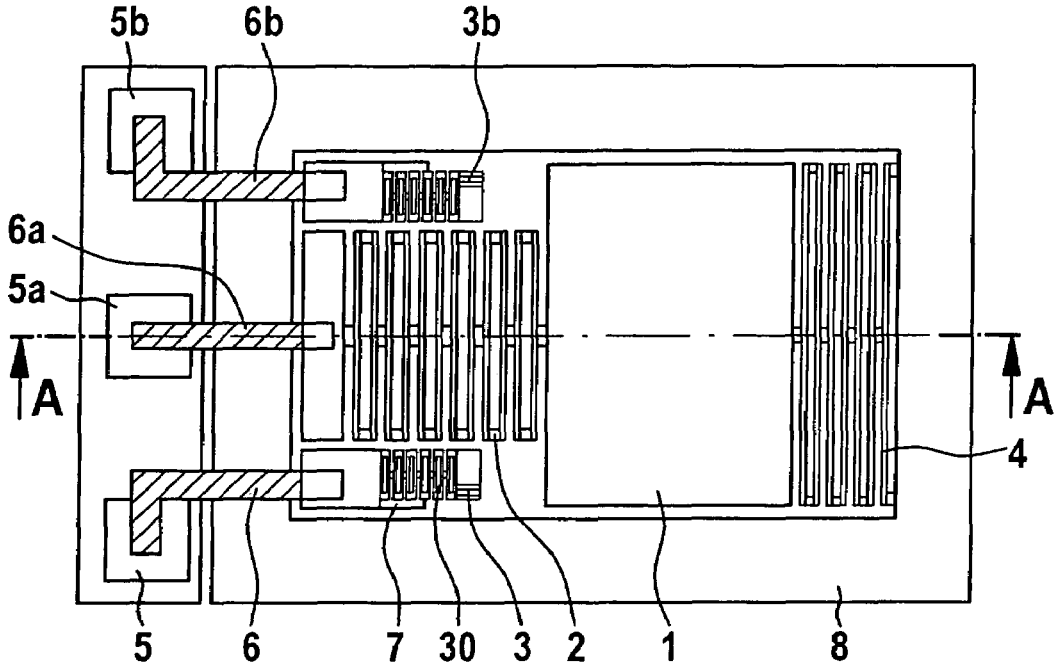
FIG. 1 shows a top view of a micromechanical switch according to the present invention.

FIG. 1 shows the micromechanical switch according to the present invention. The micromechanical switch includes a movable mass 1, which is provided, e.g., in the form of a seismic mass 1. The micromechanical switch, which is also referred to in the following discussion as an acceleration switch, also includes a spring element 2, which is referred to in the following discussion as first spring element 2. Mass 1 is connected to first spring element 2. Moreover, mass 1 is movable, first spring element 2 being displaced when there is a movement of mass 1. As a result of the displacement of first spring element 2, a restoring force is exerted on mass 1 by first spring element 2. According to the present invention, mass 1 is intended to be movable only in a linear direction of movement, for example. This direction of movement is provided in FIG. 1 along section line AA. However, the present invention may also provide that mass 1 be movable in a plurality of directions of movement. In the exemplary embodiment shown in FIG. 1, a third spring element 4 that stabilizes the movement of mass 1 is also provided. The present invention provides, in particular, that first spring element 2 is on one side of mass 1 along the direction of movement of mass 1, and that third spring element 4 is opposite first spring element 2 along the direction of movement of mass 1. First spring element 2 and third spring element 4 include, in particular, U-spring elements, which may be manufactured using standard micromechanical methods.

In addition, the micromechanical switch includes at least one contact element 3 which, according to the present invention, is connected to a second spring element 30. According to the present invention contact element 3 is a contact mass, for example, and in an advantageous embodiment the contact element 3 is connected as one piece to second spring element 30. The system of the micromechanical switch according to the present invention is such that mass 1 may be moved an initial portion of the distance along its direction of movement while first spring element 2 is displaced to a certain specified degree. After this specified degree of displacement of first spring element 2, mass 1 touches contact element 3, i.e., the contact mass. The present invention further provides that mass 1 and first spring element 2 are designed such that a movement of mass 1 beyond the specified degree of displacement of first spring element 2 is also possible. In this case, therefore, first spring element 1 is displaced even further than the specified degree of displacement, and the contact between mass 1 and contact element 3 remains during this portion of movement. In particular, the present invention provides for connecting contact element 3 to a second spring element 30 so that during the movement of mass 1 in contact with contact element 3, second spring element 30 is also displaced, in addition to the displacement of first spring element 2 beyond the specified degree of its displacement, as a result of which contact element 3 is pressed against mass 1.

The present invention also provides that the micromechanical switch has stops 7 which prevent mass 1 from executing an excessively large movement in the direction of movement.

Stop 7 therefore prevents first spring element 2 from being displaced beyond a specified maximum degree of displacement. The present invention provides that the specified maximum degree of displacement of first spring element 2 is greater than the specified degree of displacement of first spring element 2 at which the first contact between contact element 3 and mass 1 occurs.

According to the present invention, the micromechanical switch also has, for example, a bonding frame 8 and a first bonding pad 5, as well as a first conductor path 6 for contacting first bonding pad 5 to the suspension of contact element 3. In addition, the micromechanical switch according to the present invention also has a second bonding pad 5*a* and also a second conductor path 6*a* which is used for contacting second bonding pad 5*a* to the suspensions of first spring element 2. Moreover, the micromechanical switch also has a third bonding pad 5*b* and a third conductor path 6*b* which is used for contacting third bonding pad 5*b* with the suspension of an additional contact element 3*b*. Additional contact element 3*b* and its contacting devices (third bonding pad 5*b* and third conductor path 6*b*) are optional. What is essential for the operation of the micromechanical switch according to the present invention as a switch is that, via at least two bonding pads 5, 5*a*, and 5*b* and corresponding conductor paths 6, 6*a*, and 6*b*, at least two contacts are available which are in low-resistance contact with one another electrically during a corresponding movement of mass 1 such that first spring element 2 is displaced beyond the specified degree of displacement. For this purpose, the present invention may provide either that contact making between contact element 3, mass 1 and first spring element 2 and its suspension is effected toward second bonding pad 5*a*, or that contact making is effected from contact element 3 to further contact element 3*b* as well as to third conductor path 6*b* and third bonding pad 5*b* via mass 1, or even that two switches are implemented at the same time, both first contact element 3 and additional contact element 3*b* being provided and seismic mass 1 being electrically connected via second bonding pad 5*a* and second conductor path 6*a*.

Through variation of the width of the U-springs of first spring element 2, second spring element 30 and third spring element 4, and also of their webs between the U-springs, these springs or spring elements 2, 30, and 4 may be adjusted to requirements as linear or non-linear springs.

If an acceleration occurs in the detection direction, mass 1 is accelerated toward first spring element 2. Stabilizing spring 4, also referred to as third spring element 4, is operated in this case in the exemplary embodiment shown in FIG. 1 and should be selected so that it does not significantly hinder the movement of mass 1. This is implemented according to the present invention in that the spring constant of third spring element 4 is significantly lower than the spring constant of first spring element 2. Beginning at a defined position of mass 1, mass 1 comes in contact with contact element 3 and contact element 3*b* so that the switch is closed, i.e., that contact is made between the electrical terminals of contact element 3, 3*b* and mass 1, i.e., between the electric terminals of contact element 3 and additional contact element 3*b* and, optionally and in addition, mass 1 as well. A specified degree of displacement of first spring element 2 where the mass contacts at least one contact element 3 corresponds to this defined position of mass 1. Furthermore, a defined action of force on mass 1 corresponds to this specified degree of displacement of first spring element 2, an action of force which is caused, for example, by a defined acceleration of the entire micromechanical switch such that mass 1 is displaced toward contact element 3 up to the specified degree of displacement of first spring element 2.

In the event of a greater displacement or a greater acceleration toward mass 1, contact elements 3, 3*b* remain connected to mass 1. Second spring element 30 then presses contact element 3 against mass 1. In this way, bouncing of the switch is effectively prevented. Second spring element 30 of contact element 3 should retard the movement of mass 1 only insignificantly, i.e., the switch or the mass, in spite of the contact of mass 1 with contact element 3, continues to move against the restoring force of first spring element 2. According to the present invention, this is ensured by the fact that the spring constant of second spring element 30 is significantly smaller than the spring constant of first spring element 2. The shape of the force curve, however, does not become linear because of the contact of mass 1 with contact element 3. Mass 1 remains in motion as long as a sufficient acceleration is applied to the system of the micromechanical switch or mass 1 strikes stop 7 when there is an excessively large acceleration. Second spring element 30 of contact element 3 in this case serves, first, as bounce protection and, second, it is used for the purpose of prolonging the switching time of the acceleration switch since when there is a decreasing external acceleration and a reverse movement of mass 1 toward smaller displacements of first spring element 2, the contact remains closed until second spring element 30 of contact element 3 is fully relaxed. This results in the advantage that more reliable detection by the acceleration switch is possible due, in particular, to the longer switching time. This behavior of the micromechanical switch according to the present invention and also the movement of the mass in spite of a closed circuit, i.e., the movement of mass 1 when there is displacement of first spring element 2 greater than the specified degree of displacement, may be interpreted as a "moving switch."

Figure 2:
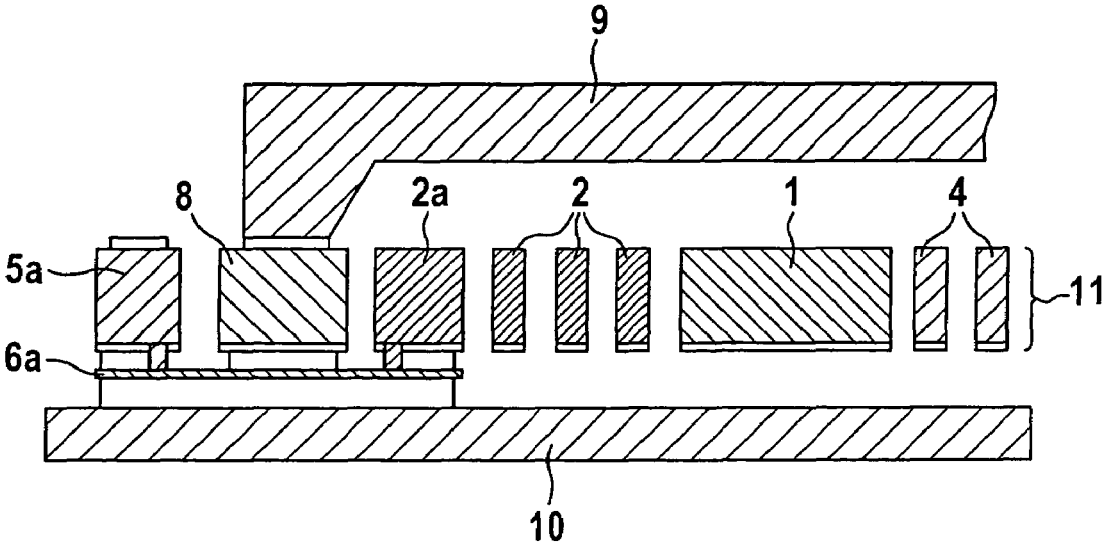
FIG. 2 shows a sectional view of the micromechanical switch according to the present invention, taken along section line AA of FIG. 1.

FIG. 2 shows a sectional view of the micromechanical switch according to the present invention taken along section line AA of FIG. 1. The view in FIG. 1 is slightly enlarged and is somewhat distorted (in terms of proportions) compared with the view in FIG. 1. FIG. 2, like FIG. 1, shows mass 1 and first spring element 2. Third spring element 4 is shown in FIG. 2 on the side of first spring element 2 opposite mass 1. FIG. 2 also shows suspension 2*a* of first spring element 2, the suspension being electrically connected to second bonding pad 5*a* by second conductor path 6*a*. Also visible in FIG. 2 is frame 8 of the micromechanical switch. The entire micromechanical switch is provided on a substrate 10, according to the present invention, and the moving parts of the micromechanical switch, i.e., in particular mass 1 and elements 2, 30, 3, 4 are covered by a cover 9. Cover 9 is not shown in FIG. 1. According to the present invention, substrate 10 is provided, in particular, in the form of a semiconductor substrate such as a silicon substrate, for example. The moving elements in the operating layer of the micromechanical switch designated in FIG. 2 by reference numeral 11 are likewise provided according to the present invention in semiconductor material, in particular, such as in silicon, for example. According to the present invention, however, other materials may also be provided. Of course it is helpful, according to the present invention, to ensure good conductivity of the material of mass 1 and first spring element 2 or second spring element 30 or in general of all elements that are used to conduct current during contact making of the switch.

What is claimed is:

1. A micromechanical switch, comprising:

a movable mass;

a first spring element connected to the movable mass;

at least one contact element; and a second spring element, wherein the at least one contact element is movable and connected to the second spring element;

wherein the first spring element is displaced when there is a specified movement of the movable mass, the movable mass and the at least one contact element being separated from one another up to a specified degree of displacement of the first spring element, and wherein the movable mass contacts the at least one contact element starting at the specified degree of displacement of the first spring element, and wherein a common movement of the movable mass and the at least one contact element is provided when the displacement of the first spring element is greater than the specified degree of displacement.

2. The micromechanical switch as recited in claim 1, wherein the first spring element includes an U-spring element.

3. The micromechanical switch as recited in claim 1, wherein at least one of the first spring element and the second spring element includes an U-spring element.

4. The micromechanical switch as recited in claim 3, wherein the spring constant of the second spring element is substantially lower than the spring constant of the first spring element.

5. The micromechanical switch as recited in claim 3, further comprising:

a third spring element providing a stabilizing effect on the movement of the movable mass.

6. The micromechanical switch as recited in claim 5, wherein the spring constant of the third spring element is substantially lower than the spring constant of the first spring element.

7. The micromechanical switch as recited in claim 1, wherein the spring constant of the second spring element is substantially lower than the spring constant of the first spring element.

8. The micromechanical switch as recited in claim 7, further comprising:

a third spring element providing a stabilizing effect on the movement of the movable mass.

9. The micromechanical switch as recited in claim 8, wherein the spring constant of the third spring element is substantially lower than the spring constant of the first spring element.

10. The micromechanical switch as recited in claim 1, further comprising:

a third spring element providing a stabilizing effect on the movement of the movable mass.

11. The micromechanical switch as recited in claim 10, wherein the spring constant of the third spring element is substantially lower than the spring constant of the first spring element.

12. The micromechanical switch as recited in claim 10, further comprising:

a stop, wherein the stop prevents displacement of the first spring element beyond a specified maximum degree of displacement of the first spring element.

13. The micromechanical switch as recited in claim 1, further comprising:

a stop, wherein the stop prevents displacement of the first spring element beyond a specified maximum degree of displacement of the first spring element.

* * * * *